United States Patent [19]

Mundus

[11] Patent Number: 4,858,842

[45] Date of Patent: Aug. 22, 1989

[54] APPARATUS FOR WINDING WEBS TO FORM SUPPLY ROLLS

[75] Inventor: Friedhelm Mundus, Lengerich, Fed. Rep. of Germany

[73] Assignee: Windmoller & Holscher, Lengerich, Fed. Rep. of Germany

[21] Appl. No.: 114,920

[22] Filed: Oct. 30, 1987

[30] Foreign Application Priority Data

Nov. 3, 1986 [DE] Fed. Rep. of Germany ..... 3637417
Oct. 6, 1987 [DE] Fed. Rep. of Germany ..... 3733780

[51] Int. Cl.[4] ..... B65H 23/198; B65H 20/24

[52] U.S. Cl. ..... 242/56.9; 242/67.1 R; 242/75.5

[58] Field of Search ..... 242/56.2, 56.9, 57, 242/67.1 R, 67.2, 75, 75.5, 75.51

[56] References Cited

U.S. PATENT DOCUMENTS 3,188,016 6/1965 Aaron ..... 242/56.9 X
3,712,554 1/1973 Lorenzini et al. ..... 242/67.1 R X

FOREIGN PATENT DOCUMENTS 1574466 7/1971 Fed. Rep. of Germany .
3141322 6/1982 Fed. Rep. of Germany .

*Primary Examiner*—David Werner
*Attorney, Agent, or Firm*—Fleit, Jacobson, Holman & Stern, Cohn, Price

[57] ABSTRACT

Apparatus for winding webs to form supply rolls under a substantially constant web tension comprises a winding shaft, which is rotatably mounted in a machine frame and driven by an electric motor, a rocker, which is pivoted to the machine frame and has mutually opposite, freely protruding arms, which are equal in length and at their ends carry freely rotatably mounted dancer rollers, and means for detecting a deflection of the rocker resulting in a displacement of said dancer rollers from a normal position, in which they are horizontally aligned. Two winding shafts are provided, the first of which is driven by a transmission from the electric motor and the second of which is driven via a differential, which has a first input member that is coupled to the first winding shaft, and via further power-transmitting means succeeding said differential. The dancer rollers disposed between the arms of the rocker are axially spaced apart by a distance from each other which equals the lateral distance between the two webs to be wound up. Each of the two webs is trained around one of the dancer rollers and around two deflecting or guiding rollers which are rotatably mounted in the machine frame and disposed on opposite sides of the associated dancer roller. The means for detecting the deflection of the rocker cause an additional torque to be applied to the second input member of the differential via a controller and a servomotor, which additional torque acts to increase or decrease the speed of the second winding shaft in dependence on the deflection of the rocker.

4 Claims, 4 Drawing Sheets

Fig.3
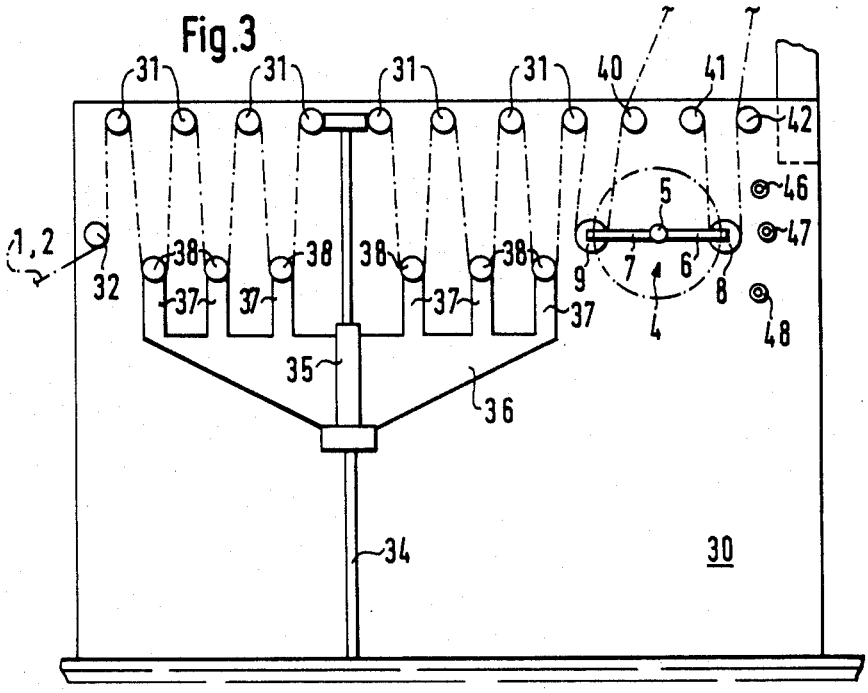
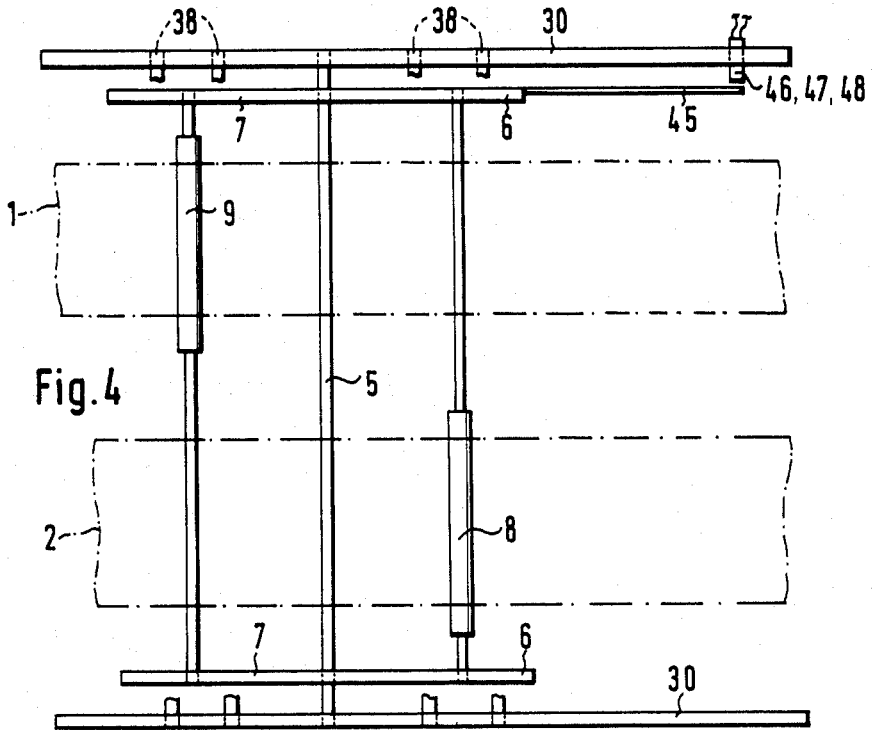
Fig.4

APPARATUS FOR WINDING WEBS TO FORM SUPPLY ROLLS

BACKGROUND OF THE INVENTION

1. Field of the Invention

This invention relates to apparatus for winding webs to form supply rolls under a substantially constant web tension comprising a winding shaft, which is rotatably mounted in a machine frame and driven by an electric motor, a rocker, which is pivoted to the machine frame and has mutually opposite, freely protruding arms, which are equal in length and at their ends carry freely rotatably mounted dancer rollers, and means for detecting a deflection of the rocker resulting in a displacement of said dancer rollers from a normal position, in which they are horizontally aligned.

2. Description of the Prior Art

Published German Application No. 15 74 466 discloses an apparatus which is of that kind and serves for winding a single web to form a supply roll. That apparatus comprises deflecting rollers, which are rotatably mounted at fixed locations in the machine frame, and a rocker, which causes the web to form a loop between said deflecting rollers and comprises arms which differ in length and carry dancer rollers. In that case a weight is required to compensate only the torque which is equal to the difference between the mutually opposing torques which are due to the tension of the web acting on the arms. That compensating weight is carried by a lever that is secured to a shaft to which the rocker is nonrotatably connected. In that known apparatus if is no longer necessary to apply large opposing torques to pairs of one-armed levers, each pair of which carries only a single dancer roller extending between said levers and subjected to a force that equals twice the force which is due to the tension of the web.

When it is desired to form supply rolls by winding webs which travel in juxtaposition and are made by a two-up processing, such as webs composed of tear-off bags, it is usually required to provide two winders, which are provided with respective web tension controllers, each of which controls the drive means of the associated winder so that the webs are wound up under substantially the same web tension. But the provision of two winders provided with respective web tension controllers involves a relatively high expenditure, which increases the cost of the plant.

SUMMARY OF THE INVENTION

For this reason it is an object of the invention to provide an apparatus which is of the kind described first hereinbefore and which permits a simultaneous winding of two webs to form supply rolls whereas the expenditure is reduced.

In an apparatus which is of the kind described first hereinbefore that object is accomplished in that two winding shafts are provided, the first of which is driven by a transmission from the electric motor and the second of which is driven via a differential, which has a first input member that is coupled to the first winding shaft, and via further power-transmitting means, succeeding said differential, the dancer rollers disposed between the arms of the rocker are axially spaced apart by a distance from each other which equals the lateral distance between the two webs to be wound up, each of the two webs is trained around one of the dancer rollers and around two deflecting or guiding rollers which are rotatably mounted in the machine frame and disposed on opposite sides of the associated dancer roller, and the means for detecting the deflection of the rocker cause an additional torque to be applied to the second input member of the differential via a controller and a servomotor, which additional torque acts to increase or decrease the speed of the second winding shaft in dependence on the deflection of the rocker.

In the apparatus in accordance with the invention the two winding shafts for winding the two supply rolls to be formed are driven by a single electric motor and are coupled to each other by a differential. That differential has a second input member, to which speed is imparted in response to a differential web tension. As a result, even though a common drive is provided for both winding shafts, any differential web tension of the webs being wound up can be compensated quickly and in a simple manner. Any differential web tension will be sensitively detected by the dancer rollers carried by the rocker because the arms of said rocker virtually constitute the arms of a balance beam and will be deflected from a horizontal position when forces which are due to different web tensions are exerted on the dancer rollers carried by said arms. As soon as sensors detect a deflection of the rocker from a horizontal position, the reversible servomotor will introduce into the differential an additional input speed so that the tension of the web being wound on the second winding shaft will be increased or decreased for a compensation by which the rocker is returend to its horizontal position.

The winding shafts may be coaxially mounted in the machine frame but preferably their axes are offset from each other so that the replacement of the supply rolls will be facilitated. Completely wound rolls can be more easily removed and replaced, e.g., by new winding tubes.

A freely protruding flag is suitably secured to the shaft to which the rocker is non-rotatably connected and said flag cooperates with signal generators, which are secured to the machine frame and generate signals in response to a deflection of the rocker in one direction and the other. In response to an angular movement of the flag in one direction or the other, a signal generator that is associated with that direction is activated or initiated and via the controller causes the servomotor to rotate at a corresponding speed in a positive or negative sense. When the rocker is in a horizontal or zero position, the servomotor will be inoperative so that an additional speed will not be imparted to the differential.

In a different embodiment of the invention, plates or flages having a wedge-shaped or curved contour are secured to the shaft to which the rocker is non-rotatably connected or to the arms of said rocker and cooperate with signal generators, which are secured to the machine frame and provided with two-dimensional sensors, which are adapted to be covered by said plates or flags, wherein said signal generators generate signals which correspond to or are proportional to the surface area in which said sensors are covered or swept by said plates or flags, and said signals cause the speedcontrolled servomotor to operate at a speed corresponding to the signals. In that embodiment the additional speed which is applied to the differential in a positive or negative sense can be infinitely controlled. When the servomotor is controlled in that manner, it may operate slowly when the rolls being wound are large so that a few revolutions will be sufficient for the control, whereas the servomotr can be rotated at a higher speed during the winding of small rolls. The controlled servomotor may consist of a d.c motor or of a frequency-controlled motor.

BRIEF DESCRIPTION OF THE DRAWING

FIG. 3 is a side elevation showing the lefthand part of the apparatus of FIG. 1.

FIG. 4 is a top plan view showing the rocker on a larger scale.

DETAILED DESCRIPTION OF THE PREFERRED EMBODIMENTS

Figure 1:
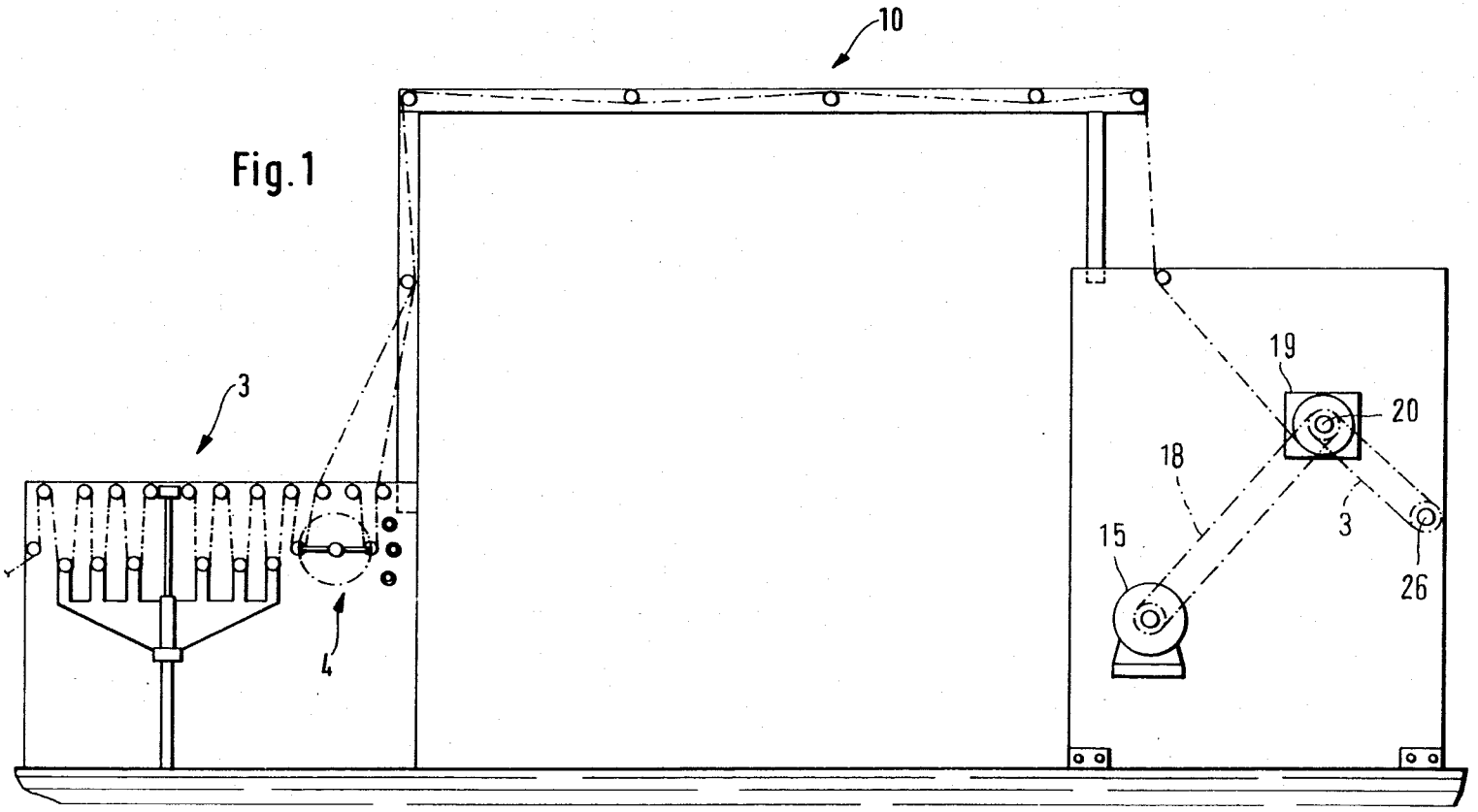
FIG. 1 is a side elevation of apparatus for a simultaneous winding of two webs which travel in juxtaposition.
Figure 2:
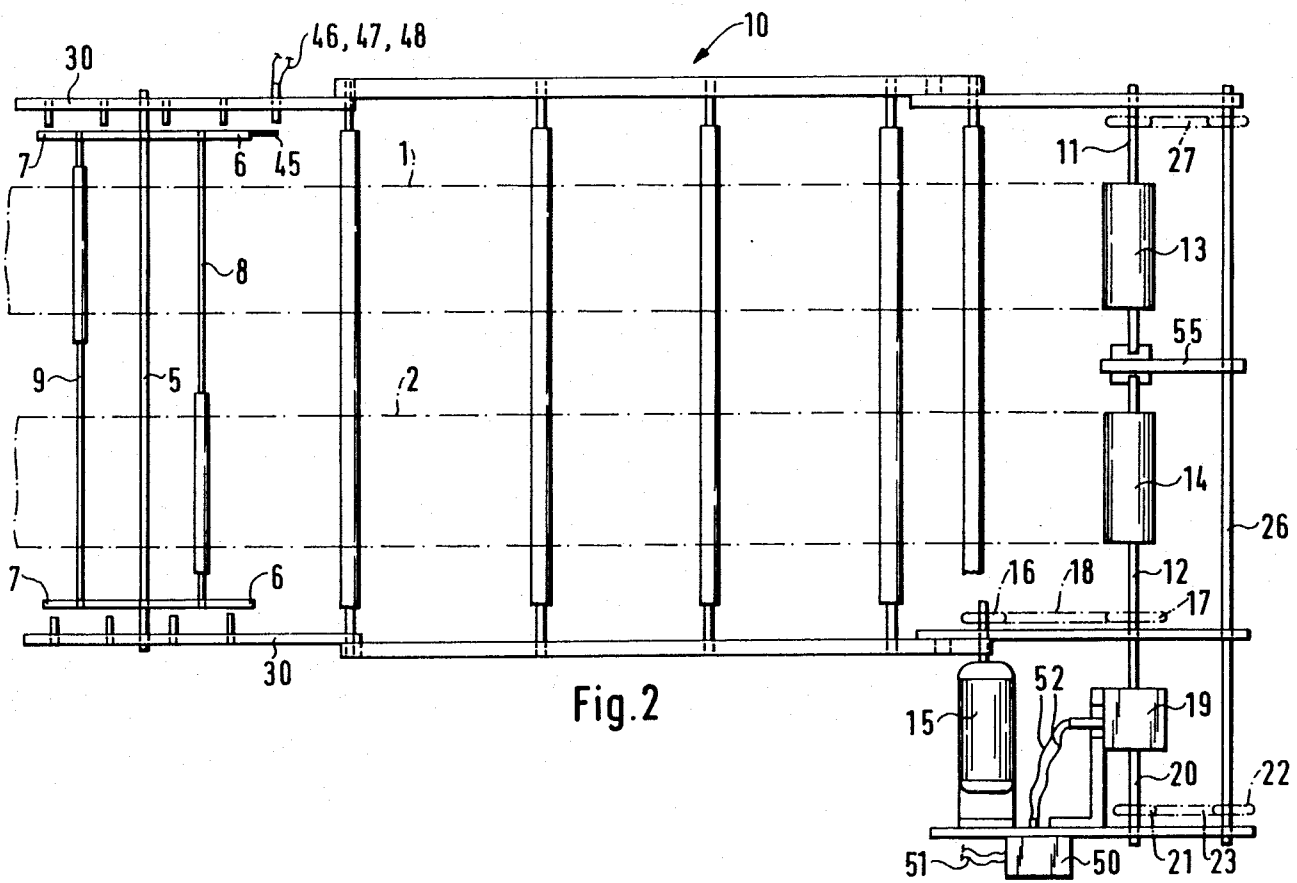
FIG. 2 is a top plan view showing the apparatus of FIG. 1.

Two webs 1, 2 consist each, for instance, of a series of tear-off bags which have been made by a bag-making machine and are joined by tear-off perforation lines. The webs 1, 2 are fed via a looper 3 to a rocker 4, which has pairs of arms 6, 7, which are equal in length. The arms 6, 7 are secured to a rocker shaft 5 and protrude from said shaft in a plane. A dancer roller 8 or 9 is rotatably mounted between to and extends between the arms of each pair 6 or 7. From said dancer rollers 8, 9, the webs 1, 2 travel around guide rollers, which are mounted on a bridge 10, to supply rolls 13, 14, which are being formed on the winding shafts 11, 12.

The winding shaft 12 is directly driven by an electric motor 15 via a chain drive or cogged V-belt drive 16, 17, 18. The winding shaft 12 is coupled to the input shaft of the differential 19. A gear 21 is splined to the output shaft 20 of the differential 19 and via a chain drive or cogged V-belt drive 23 and a gear 22 drives the transmitting shaft 26, which via a chain drive or cogged V-belt drive 27 is operatively connected to the winding shaft 11.

The several parts of the apparatus will now be described more in detail.

The looper 3 comprises stationary guide rollers 31, which are freely rotatably mounted in the machine frame 30 approximately in a horizontal plane, and a guide roller 32, which precedes the guide rollers 31 and is also stationary and rotatably mounted in the machine frame. Vertical guide rods 34 are secured to the machine frame. Slide bushings 35 are longitudinally slidably mounted on the guide rods 34 and carry respective lifting rakes 36. Tensioning rollers 38 are freely rotatably mounted on and extend between adjacent upstanding tines of said rakes. The tension rollers 38 act to form the webs 1, 2 into loops in the accordionlike pattern shown in FIGS. 1 and 3. When it is desired to thread a web into the apparatus, the lifting rake can be raised until the tensioning rollers 38 are disposed above the guide rollers 31 so that the webs 1, 2 can freely be threaded between the rollers. The lifting rake is then lowered so that loops are formed in the webs under the weight of the lifting rake.

From the last guide rollers 31 of the looping unit 3 the webs 1, 2 move to the dancer rollers 8, 9. The cnetral shaft 5, to which the arms 6, 7 of the rocker 4 are secured, is freely rotatably mounted in the machine frame 30.

By the dancer roller 9, a loop is formed in the web 1 between the stationary deflecting rollers 31, 40, which are rotatably mounted in the machine frame. By the dancer roller 8, a loop is formed in the web 2 between the stationary deflecting rollers 41, 42, which are rotatably mounted in the machine frame.

One of the arms 6 of the rocker 4 carries an extension, which consists of a sheet metal flag 45 and cooperates with sensors or initiators 46, 47, 48, which are secured in a side frame. When the rocker 4 is in its normal, horizontal position, the sheet metal flag 45 causes the sensor 47 to generate a signal. As the rocker 4 is moved from its normal position in the clockwise sense in FIG. 3, a signal is generated by the sensor 48. A movement of the rocker 4 in a counterclockwise sense in FIG. 3 will cause the sensor 46 to generate a signal.

The signals generated by the initiators 46 to 48 in response to the movement of the sheet metal flag 45 are delivered in leads 51 to a controller 50, which comprises an amplifier and which via leads 52 energizes a servomotor, which is integrated in the differential 19 and drives the second input member of the differential at an additional speed.

Figure 5:
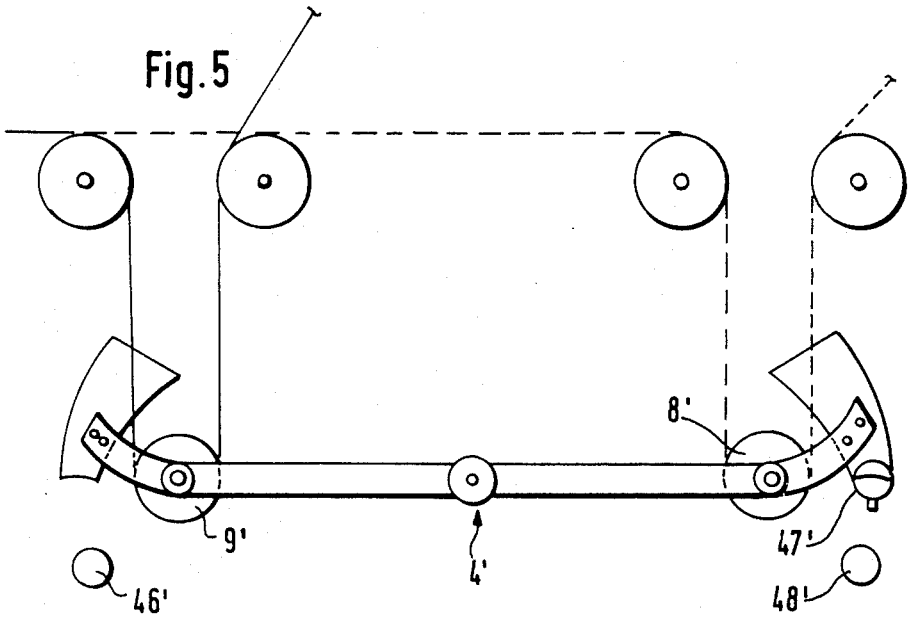
FIG. 5 is a side elevation showing another embodiment of the rocker, which is provided with curved flags for cooperation with signal generators.
Figure 6:
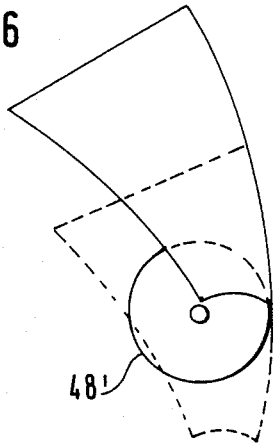

In the embodiment shown in FIGS. 5 and 6 the dancer rollers 8', 9' are carried by the arms of the rocker 4' and said arms are provided with flags having the shape of curved wedges. Said flags cooperate with two-dimensional sensors 46', 47', 48', which are comprised in the signal generators and fixed to the machine frame. As a result, the signal generators generate signals which are proportional to the area in which the sensors 46', 47', 48' are covered by the flags. It is apparent form FIG. 6 that the area in which the sensor 48' of the signal generator is covered increases as the deflection of the rocker arms increases. In response to an increase of the covered sensor area, a controller, not shown, causes the servomotor associated with the differential 19 to operate at an increasing speed. The sense of rotation of the servomotor will depend on the direction of the angular movement of the rocker.

In the embodiment shown by way of example the outer ends of the winding shafts 11, 12 are rotatably mounted in the side members of the machine frame and the inner ends of said shafts are rotatably mounted in separate bearings, which are carried by a carrier 55. Alternatively, the axes of the winding shafts 11, 12 may be offset and/or the winding shafts may be mounted with an overhang so that they will be more easily accessible for a removal of completely wound rolls and for a subsequent fitting of new winding tubes.

When the apparatus described hereinbefore is used, e.g., to wind webs consisting of tear-off bags, the speed of the winding shaft can be automatically controlled to maintain the web tension at the required value, which is sufficient for a proper winding whereas a tearing along the perforation lines will be prevented.

I claim:

1. Apparatus for winding webs to form supply rolls under a substantially constant web tension comprising a machine frame, a first winding shaft rotatably mounted in said machine frame, an electric motor connected to drive said shaft, dancer rollers, a rocker pivoted to the machine frame and having mutually opposite, freely protruding arms equal in length and at their ends carrying said dancer rollers freely rotatably mounted, means for detecting a deflection of the rocker resulting in a displacement of said dancer rollers from a normal position, in which they are horizontally aligned, a differential having first and second inputs and an output, said first winding shaft being coupled to said first input to said differential, a second winding shaft, power-transmitting means coupling the output of said differential to said second winding shaft, the dancer rollers disposed between the arms of the rocker being axially spaced apart by a distance from each other which equals the lateral distance between the two webs to be wound up, two guiding rollers rotatably mounted in the machine frame and disposed on opposite sides of each dancer roller for training a web around said dancer roller and said two guiding rollers, a servomotor coupled to said second input of said differential, and controlling means responsive to the means for detecting a deflection of the rocker for controlling said servomotor to apply an additional torque to the second input member of the differential to increase or decrease the speed of the second winding shaft in dependence on the deflection of the rocker.

2. Apparatus according to claim 1, wherein that the winding shafts are rotatably mounted in the machine frame and their axes are offset from each other.

3. Apparatus according to claim 1, wherein said means to detect includes a freely protruding flag secured to the rocker cooperating with signal generator means for generating signals in response to deflection of the rocker in one direction or the other.

4. Apparatus according to claim 1, wherein said means to detect includes plates or flags having a curved or wedge-shaped contour secured to the rocker and cooperating with signal generator means provided with two-dimensional sensors, which are adapted to be covered by said plates or flags, for generating signals which correspond to or are proportional to the surface area of said sensors covered or swept by said plates or flags, and said signals causing the servomotor to operate at a speed corresponding to the signals.

* * * * *